US006973979B2

(12) United States Patent
Carriere et al.

(10) Patent No.: US 6,973,979 B2
(45) Date of Patent: Dec. 13, 2005

(54) DRILLING RIG APPARATUS AND DOWNHOLE TOOL ASSEMBLY SYSTEM AND METHOD

(75) Inventors: Gene Carriere, Medicine Hat (CA); Don Goldade, Medicine Hat (CA)

(73) Assignee: Savanna Energy Services Corp., Calgary (CA)

( * ) Notice: Subject to any disclaimer, the term of this patent is extended or adjusted under 35 U.S.C. 154(b) by 87 days.

(21) Appl. No.: 10/690,749

(22) Filed: Oct. 23, 2003

(65) Prior Publication Data

US 2004/0206551 A1 Oct. 21, 2004

Related U.S. Application Data

(60) Provisional application No. 60/462,738, filed on Apr. 15, 2003.

(51) Int. Cl.[7] ..... E21B 3/06; E21B 19/22

(52) U.S. Cl. ..... 175/203; 166/77.2; 166/77.1

(58) Field of Search ..... 175/162, 122, 175/203; 166/379, 385, 384, 77.1–77.3

(56) References Cited

U.S. PATENT DOCUMENTS

| | | | | |
|---|---|---|---|---|
| 3,042,377 A | | 7/1962 | Woolslayer et al. | |
| 3,464,507 A | * | 9/1969 | Smith et al. | 175/85 |
| 3,734,210 A | * | 5/1973 | Wilderman | 175/85 |
| 4,265,304 A | * | 5/1981 | Baugh | 166/77.2 |
| 5,842,530 A | | 12/1998 | Smith et al. | |
| 5,975,207 A | | 11/1999 | Smitherman | |
| 6,003,598 A | | 12/1999 | Andreychuk | |
| 6,065,550 A | | 5/2000 | Gardes | |
| 6,158,516 A | | 12/2000 | Smith et al. | |
| 6,273,188 B1 | | 8/2001 | McCafferty et al. | |
| 6,332,501 B1 | | 12/2001 | Gipson | |
| 6,431,286 B1 | | 8/2002 | Andreychuk | |
| 6,502,641 B1 | | 1/2003 | Carriere et al. | |
| 6,609,565 B1 | | 8/2003 | Andreychuk et al. | |
| 6,668,684 B2 | | 12/2003 | Allen et al. | |
| 2003/0079883 A1 | | 5/2003 | McCulloch et al. | |
| 2003/0098150 A1 | * | 5/2003 | Andreychuk | 166/77.2 |

FOREIGN PATENT DOCUMENTS

| | | | |
|---|---|---|---|
| CA | 2189376 | 11/1996 | |
| CA | 2292214 | 12/1999 | E21B 19/22 |
| CA | 2298089 | 2/2000 | E21B 19/22 |
| CA | 2235555 | 9/2000 | E21B 19/15 |
| CA | 2322916 | 10/2000 | E21B 7/02 |
| CA | 2332420 | 1/2001 | E21B 19/22 |
| CA | 2322917 | 4/2002 | |
| CA | 2419650 | 2/2003 | |
| CA | 2364147 | 5/2003 | |

* cited by examiner

*Primary Examiner*—Frank S. Tsay
*Assistant Examiner*—K. Thompson
(74) *Attorney, Agent, or Firm*—Bracewell & Giuliani, LLP

(57) ABSTRACT

A drilling rig is provided which is adapted to selectively drill using coiled tubing and jointed-pipe. The rig includes a base, a mast, a top drive slidably mounted to said mast for performing jointed-pipe operations, and a tubing injector for performing coiled tubing operations, mounted on said mast for selective movement from a first position in which the injector is in line with the mast and a second position in which the injector is out of line with the mast to permit jointed-pipe operations by the top drive. The rig is uniquely suited to easily and quickly assemble bottom hole assemblies (BHA's), and to connect such BHA's to coiled tubing.

41 Claims, 11 Drawing Sheets

DRILLING RIG APPARATUS AND DOWNHOLE TOOL ASSEMBLY SYSTEM AND METHOD

CROSS-REFERENCE TO RELATED APPLICATIONS

This application claims the benefit of U.S. Provisional Application filed Apr. 15, 2003 under No. 60/462,738 which is incorporated herein in its entirety.

FIELD OF THE INVENTION

The invention relates to oil and gas drilling rigs, and in particular oil and gas drilling rigs used to drill using both coiled tubing and jointed-pipe.

BACKGROUND OF THE INVENTION

The use of coiled tubing (CT) technology in oil and gas drilling and servicing has become more and more common in the last few years. In CT technology, a continuous pipe wound on a spool is straightened and pushed down a well using a CT injector. CT technology can be used for both drilling and servicing.

The advantages offered by the use of CT technology, including economy of time and cost are well-known. As compared with jointed-pipe technology wherein typically 30–45 foot straight sections of pipe are connected one section at a time while drilling the well bore, CT technology allows the continuous advancement of piping while drilling the well significantly reducing the frequency with which such drilling must be suspended to allow additional sections of pipe to be connected. This results in less downtime, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a pilot hole using jointed-pipe, cement casing into the pilot hole, and then switch over to CT drilling. Additionally, when difficult formations such as boulders or gravel are encountered down-hole, it may be necessary to switch from CT drilling to jointed-pipe drilling until the formation is overcome, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed-pipe operations may be necessary to run casing into the drilled well. These types of situations require the drilling manager to switch back and forth between CT drilling rigs and jointed-pipe drilling rigs, a process which results in significant down-time as one rig is moved out of the way, and another rig put in place.

Another disadvantage of CT drilling is the time-consuming process of assembling a BHA (bottom-hole-assembly—the components at the end of the CT for drilling, testing, etc.), and connecting the BHA to the end of the CT. Presently, this step is performed manually through the use of rotary tables and make/breaks. Not only does this process result in costly down-time, but it can also present safety hazards to the workers as they are required to manipulate heavy components manually.

SUMMARY OF THE INVENTION

This invention provides an improved rig for drilling oil and gas wells. The rig includes components which permit both coiled tubing and jointed-pipe drilling with a minimum of steps and time required to switch between the two. The setup of the rig also allows the easy and time-efficient assembly of bottom hole assemblies (BHA's), and their connection to coiled tubing.

In a broad aspect, the present invention provides a rig for drilling a well, comprising a base, a mast mounted on said base, a top drive operable to engage and rotate downhole equipment slidably mounted on said mast for longitudinal sliding along said mast, and a coiled tubing injector operable to move coiled tubing in and out of said well mounted on said mast such that the coiled tubing injector may be selectively transposed between a first position in which the injector is in line with the mast, to a second position in which the injector is out of line with the mast to accommodate manipulation of down-hole equipment by the top drive.

In another aspect, the present invention provides a BHA (bottom hole assembly) assembling system for assembling a BHA for use in coiled tubing drilling, said BHA assembling system comprising a base, a mast mounted on said base, a top drive operable to engage and rotate BHA elements slidably mounted on said mast for longitudinal sliding along said mast, a coiled tubing injector operable to move coiled tubing on to and off of a BHA mounted on said mast such that the coiled tubing injector may be selectively transposed between a first position in which the injector is in line with the mast, to a second position in which the injector is out of line with the mast to accommodate manipulation of BHA elements by the top drive, and a rotary table operable to engage and rotate BHA elements, mounted on said base in line with the mast.

In a further aspect, the present invention provides a method of assembling a plurality of threaded BHA (bottom hole assembly) elements into a BHA for use in coiled tubing drilling, each of said BHA elements having an upper end and a lower end. The method uses a BHA assembling system having a base, a mast mounted on said base, a top drive operable to engage and rotate BHA elements slidably mounted on said mast for longitudinal sliding along said mast, a coiled tubing injector operable to move coiled tubing on to and off of a BHA mounted on said mast such that the coiled tubing injector may be selectively transposed between a first position in which the injector is in line with the mast, to a second position in which the injector is out of line with the mast to accommodate manipulation of BHA elements by the top drive, and a rotary table mounted on said base in line with the mast, operable to engage and rotate BHA elements. This method comprises:

a) transposing the coiled tubing injector to its second position in which the injector is out of line with the mast;

b) sliding the top drive to a position along the mast in spaced relation to the rotary table;

c) placing a bottom element of the BHA into the rotary table;

d) operating the rotary table to engage the bottom element of the BHA;

e) placing a second element of the BHA such that its upper end is adjacent to the top drive;

f) operating the top drive to engage the second element of the BHA;

g) positioning the second element such that its lower end is adjacent to the upper end of the bottom element of the BHA;

h) operating said top drive and/or said rotary table to rotate the second element and/or the bottom element relative to each other so as to screw the two elements together;

i) operating the top drive to disengage the second element of the BHA;

j) sliding the top drive along the mast to a position in spaced relation to the second element;

k) repeating steps e) through j) for the remaining elements of the BHA;

l) sliding the top drive along the mast to a position above the coiled tubing injector;

m) transposing said coiled tubing injector to its first position in which the injector is in line with the mast;

n) operating said coiled tubing injector to move coiled tubing having a threaded end, to a position adjacent the assembled BHA;

o) operating said rotary table to rotate the BHA so as to screw the BHA onto said threaded end of the coiled tubing; and p) operating said rotary table to disengage the BHA.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
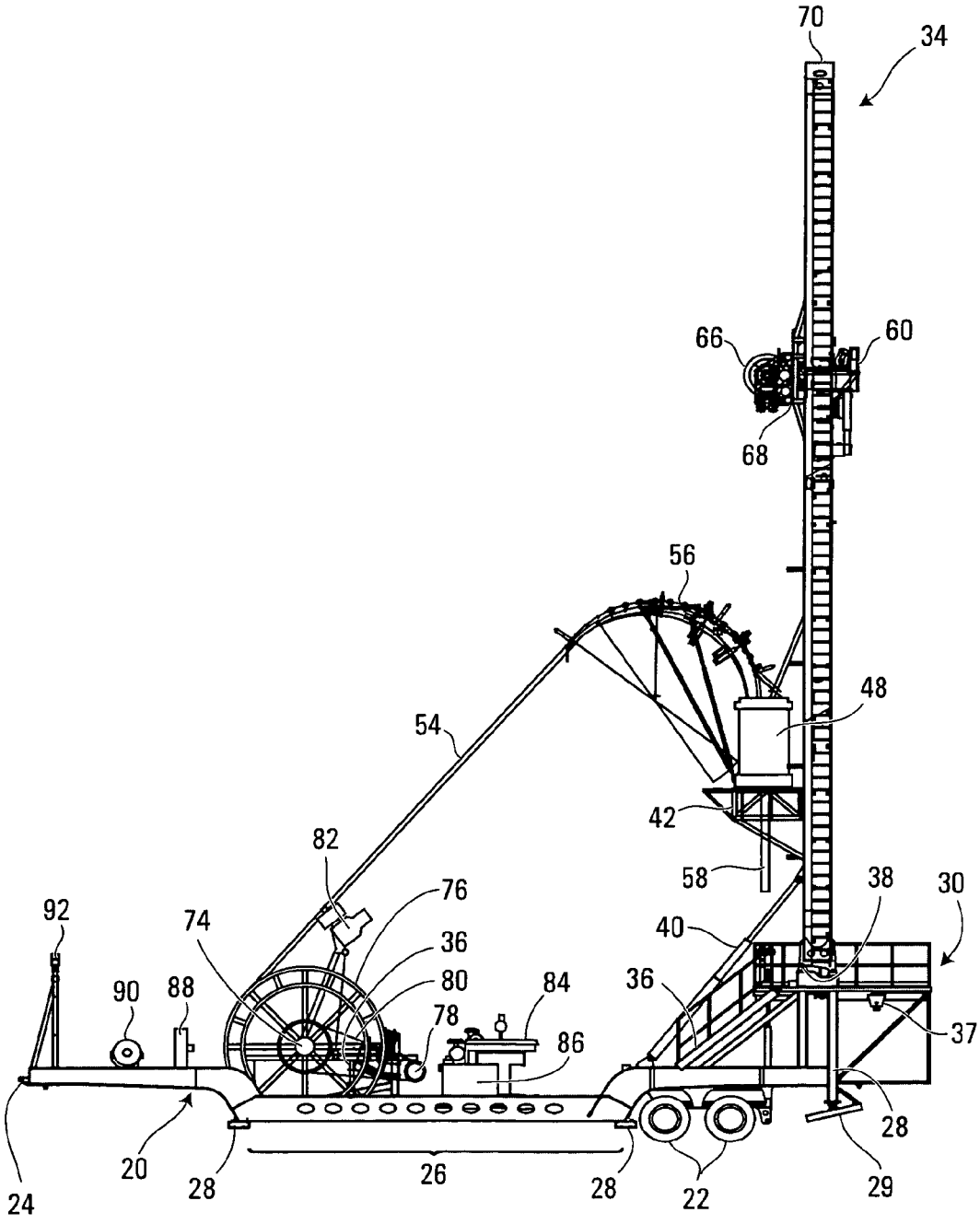
FIG. 1 is a side view of a preferred embodiment of the rig of the present invention shown in jointed-pipe drilling mode.
Figure 2:
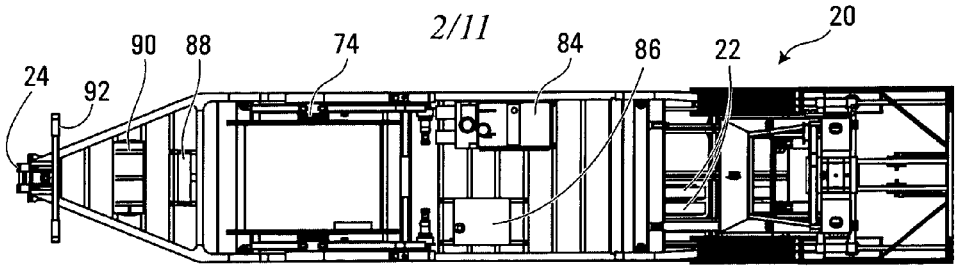
FIG. 2 is a top view of a trailer of the rig of FIG. 1.
Figure 3:
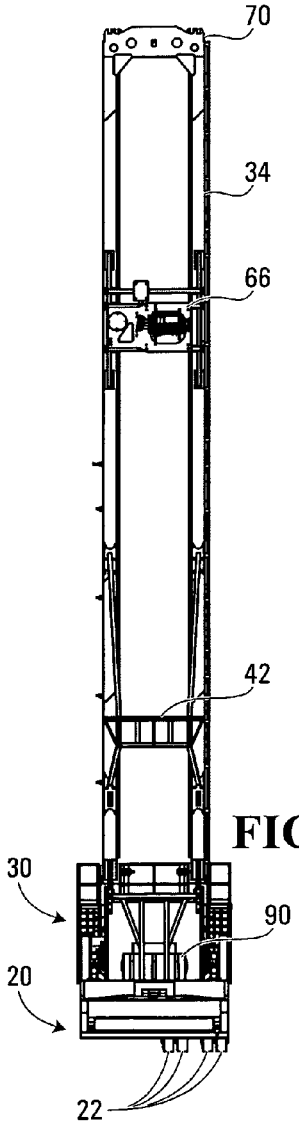
FIG. 3 is a front view of the rig of FIG. 1.
Figure 4:
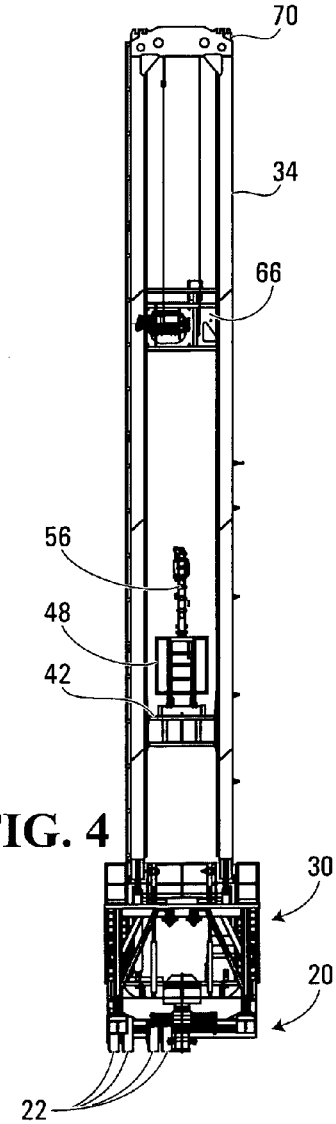
FIG. 4 is a rear view of the rig of FIG. 1.

A preferred embodiment of the rig of the present invention is shown in the attached drawings. Its basic features are shown in FIG. 1.

In a broad sense, this rig includes a base, a mast, and drilling components.

In this preferred embodiment, the base is a wheeled carrier or trailer 20 which is adapted to be pulled by a motorized vehicle. The trailer 20 has wheels 22 located near its rear, and a hitch 24 located near its front for attachment to a motorized vehicle (not shown). The trailer 20 also has a lowered middle portion 26 so as to lower the center of gravity of the components placed on this portion of the trailer 20. While the wheeled carrier of the preferred embodiment rig has been described and illustrated as being one which is adapted to be pulled by a motorized vehicle, it is to be understood that the wheeled carrier may itself be self-propelled.

The trailer 20 has mounted thereon retractable outriggers or stabilizer legs 28 for stabilizing and levelling the rig for drilling. Three stabilizer legs 28 are located on each side of the rig, at the front of the lowered middle portion 26, the rear of the lowered middle portion 26 and at the rear of the trailer 20. The stabilizer legs 28 have pontoons 29 mounted at their ends to ensure positive contact with the ground. In the preferred embodiment rig, a single long pontoon is attached to the front two legs 28 on each side of the rig, while a shorter pontoon is attached to the rear leg 28 on each side.

Figure 11:
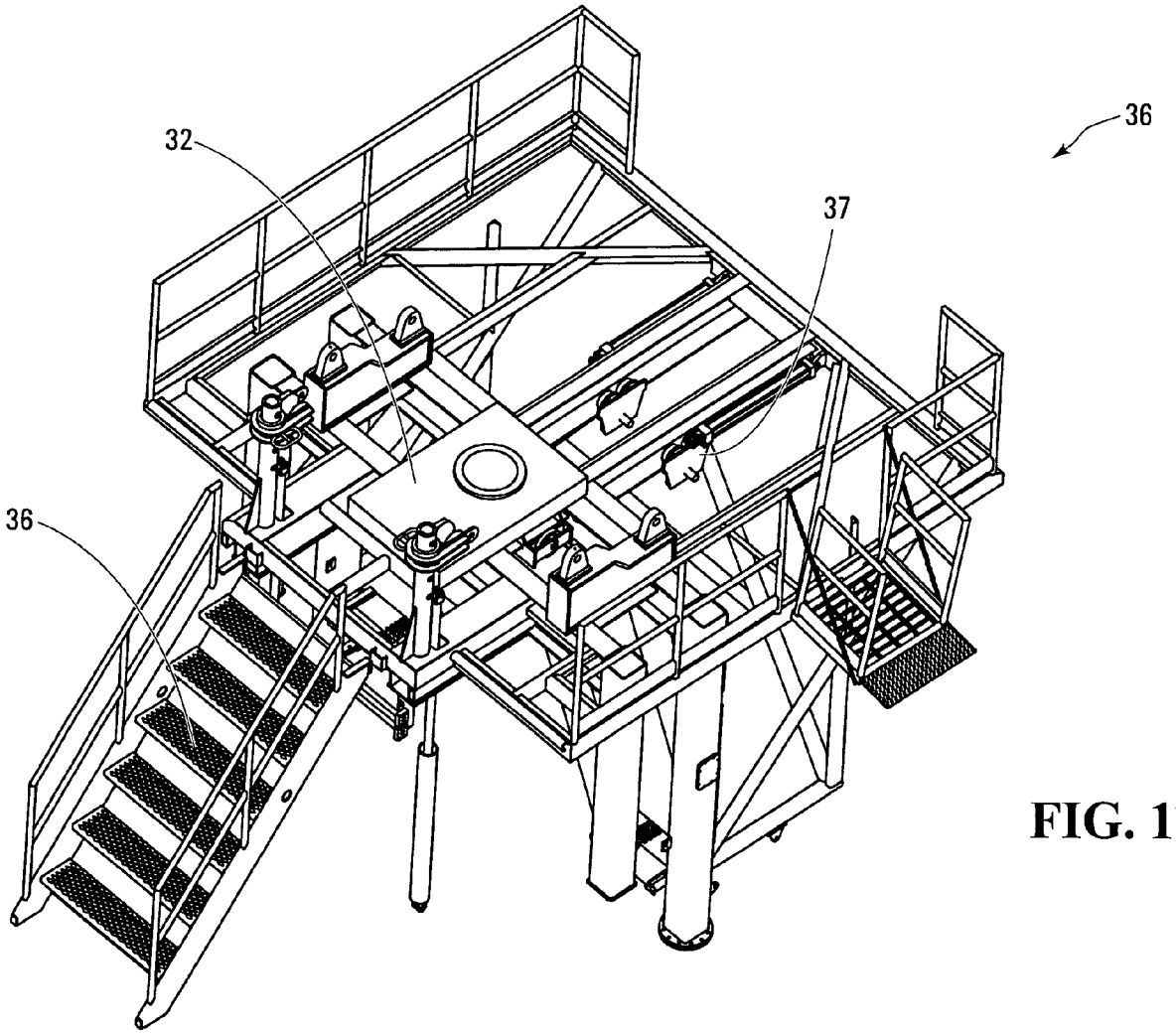
FIG. 11 is a top perspective view of a substructure of the rig of FIG. 1.

Near the rear of the trailer is mounted a drilling substructure 30, essentially a raised platform supporting a rotary table 32, as seen in FIG. 11, and a mast 34. Stairs 36 are attached to the substructure 30 to allow workers to ascend to the substructure 30.

The rotary table 32 is a collar adapted to engage downhole equipment including tubing (coiled tubing or jointed-pipe for example) through the use of slips or wedges 33 (FIGS. 13, 14), and which is hydraulically powered for rotation. The rotary table 32 is used to engage and rotate (or prevent rotation of) equipment inserted therein. The substructure 30 also has mounted thereon BOP hangers 37 below the rotary table 32 to allow raising and lowering of BOP's (blow-out preventers) off of, and onto a wellhead.

Figure 7:
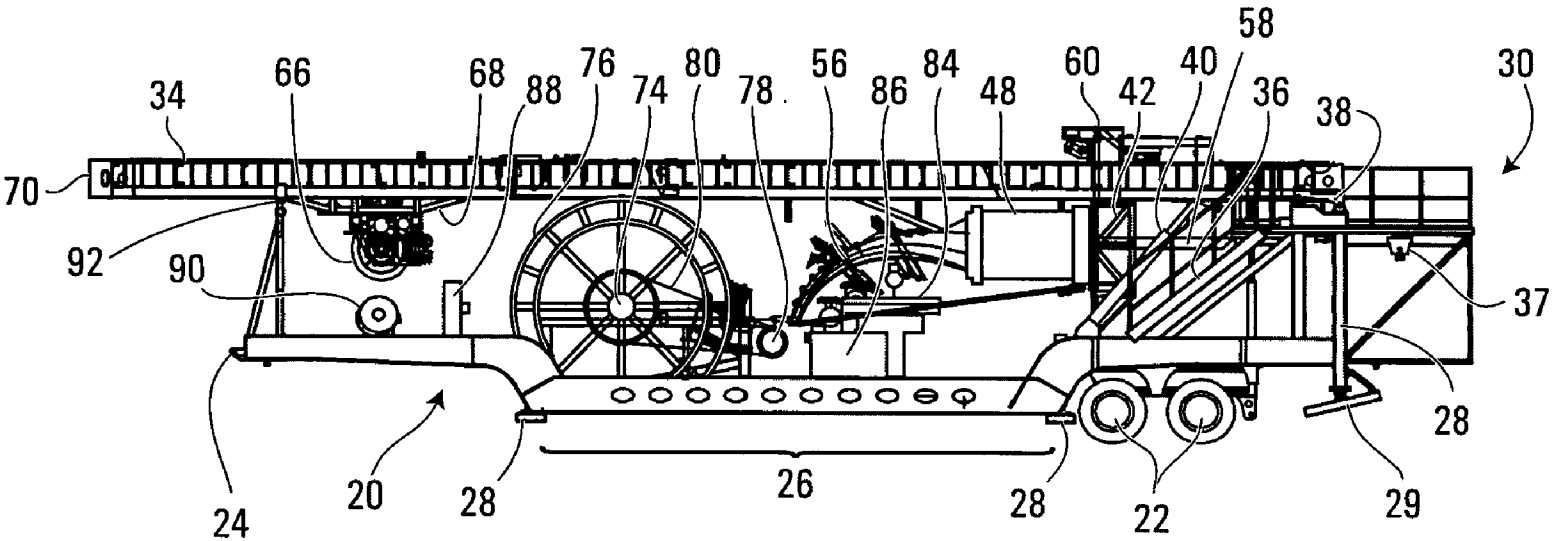
FIG. 7 is a side view of the rig of FIG. 1 shown in transportation mode.

The mast 34 is pivotally attached to the substructure 30 at mast mounting pins 38 for pivotal movement between a horizontal transportation position as shown in FIG. 7, and a vertical operating position as shown in FIG. 1. Although not illustrated, the rig could be modified such that the mast 34 could also operate at any operating angle in between the horizontal and vertical position to permit off-vertical drilling. Such modifications would include providing a support for the mast at off-vertical angles, and modifying the placement of the rotary table 32 and BOP hangers 37 to accommodating tilting of these elements with the mast. The vertical/horizontal orientation of the mast is controlled by a hydraulic cylinder 40 connected at its ends to the trailer 20 and the mast 34.

Figure 10:
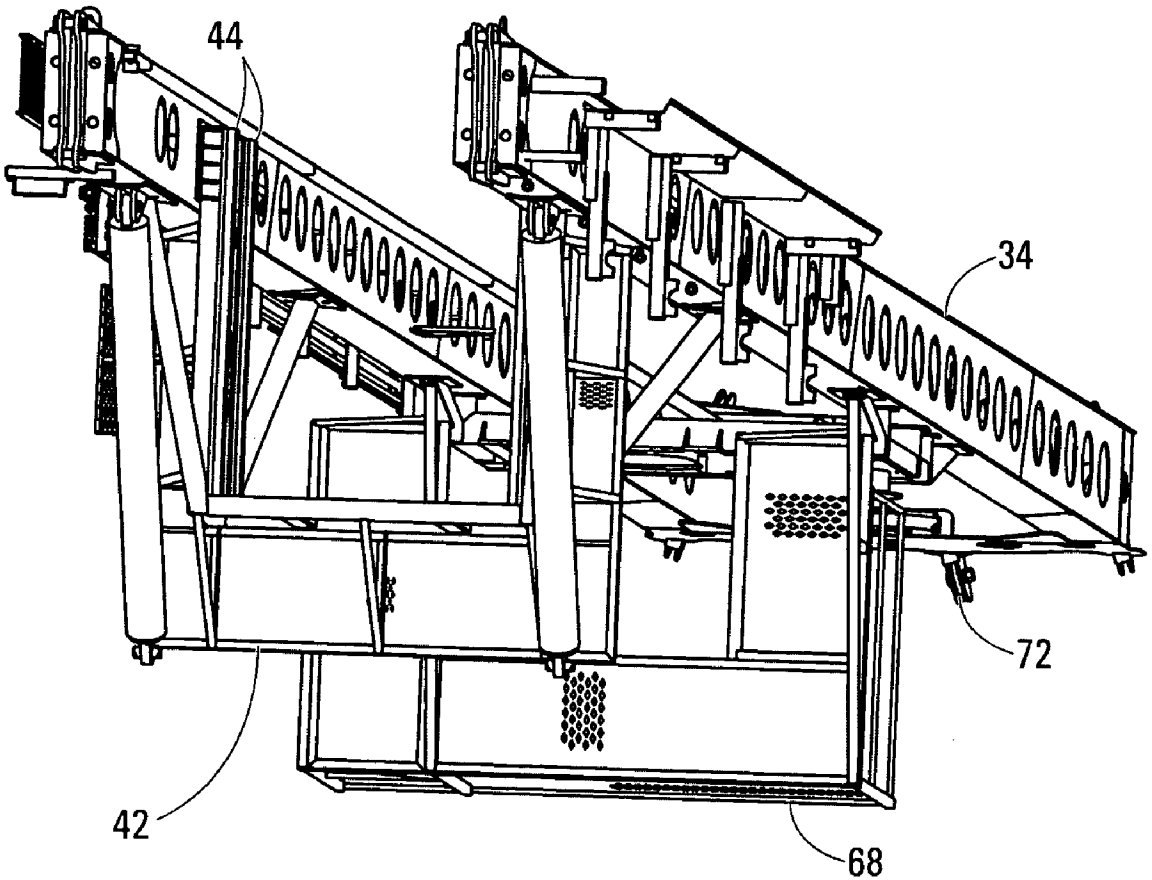
FIG. 10 is a bottom perspective view of the mast of the rig of FIG. 1.

A coiled tubing injector platform 42 is mounted on the front of the mast 34 near the point at which the mast 34 is pivotally attached to the substructure 30, in the preferred embodiment at about 12 feet up the mast 34. Forming part of the injector platform 42 are two sets of v-rails 44 (one set shown in FIG. 10) extending substantially perpendicularly from the mast 34. These v-rails 44 are located on either side of the interior of the injector platform 42.

Figure 8:
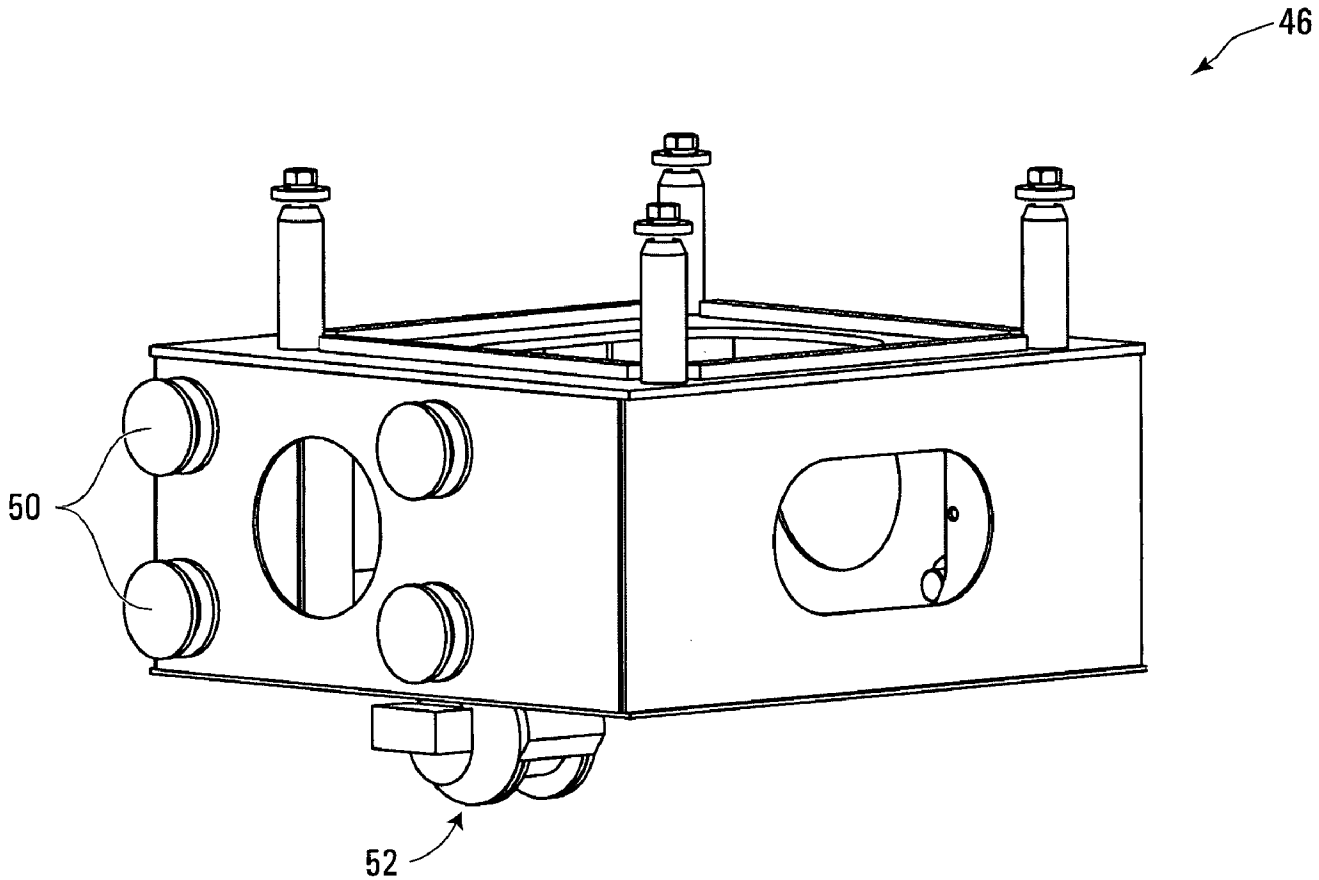
FIG. 8 is a perspective view of an injector dolly of the rig of FIG. 1.
Figure 9:
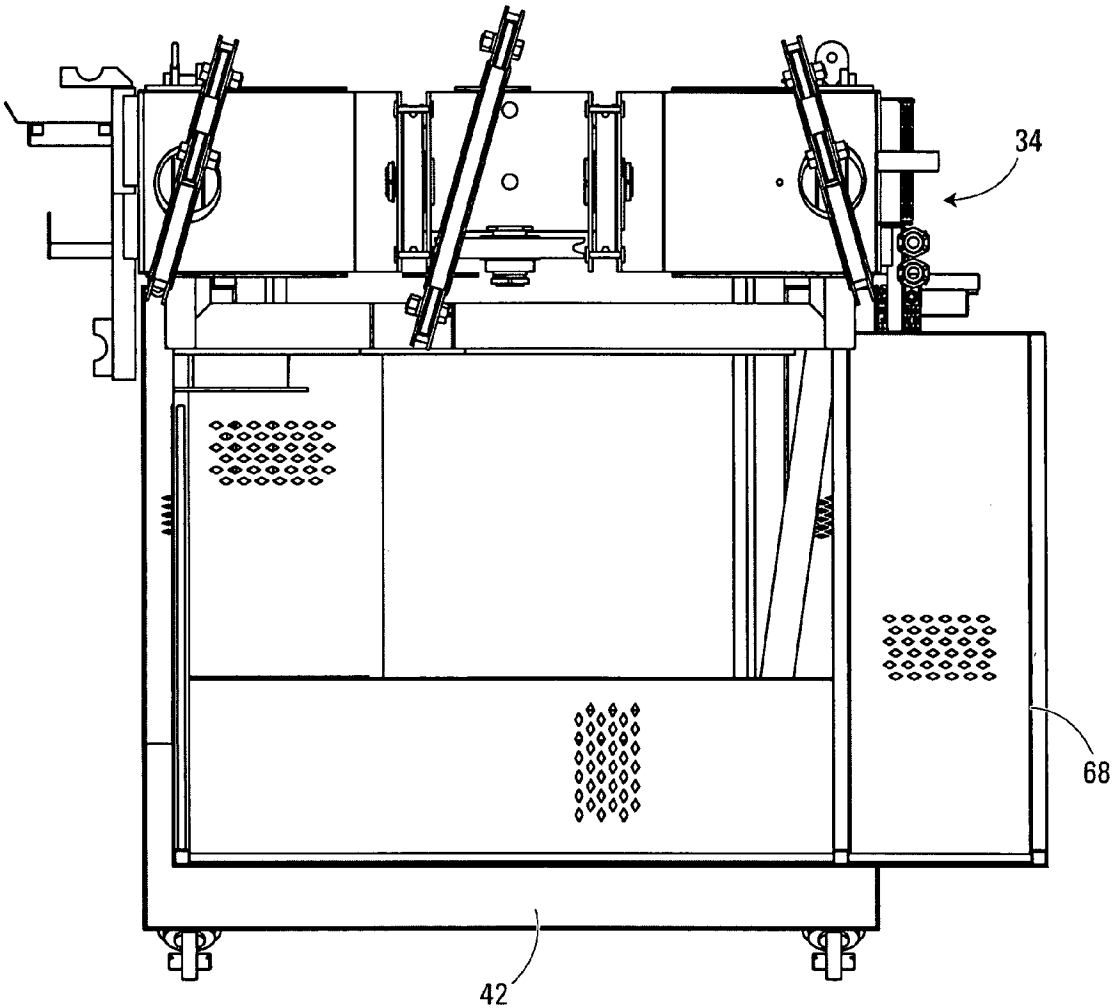
FIG. 9 is a top view of a mast of the rig of FIG. 1.

Riding on these v-rails 44 is an injector dolly 46 (shown in detail in FIG. 8). The injector dolly is a box-shaped component having mounts for receiving a coiled tubing injector 48, and four v-groove rollers 50 located on either side for riding on the v-rails 44 of the injector platform 42. Located below the injector dolly 46 is a lubricator winch 52 whose purpose is discussed in greater detail below. The movement of the injector dolly 46 on the v-rails 44 is controlled by injector hydraulic cylinders (not shown) connected at their ends to the injector dolly 46 and the injector platform 42. The injector hydraulic cylinders are used to selectively move the injector dolly 46 and the coiled tubing injector 48 mounted thereon between a first position in which the injector is in line with the mast 34, and a second position in which the injector 48 is out of line with the mast 34 so as to allow other componentry to use the mast 34, as discussed further below.

The coiled tubing injector 48 is mounted atop the injector dolly 46 and consists of a series of rollers and guides (not shown in detail) used to push, pull and guide coiled tubing 54 into and out of the well. The structure and functionality of coiled tubing injectors are well known and will not be discussed in detail herein. Extending from the top of the injector 48 is an injector arch 56 used to guide the coiled tubing 54 in a gentle arch prior to entry into the injector 48. Extending below the injector 48 is a telescoping lubricator 58 which serves to guide the coiled tubing 54 as it exits the injector 48. The lubricator 58 is telescoping to permit access to the coiled tubing 54 during connection/disconnection with a bottom hole assembly 59 (FIGS. 13, 14) as further discussed below. The lubricator 58 is extended or contracted by the lubricator winch 52 located below the injector dolly 46.

In the preferred embodiment rig of the present invention, the coiled tubing injector 48 is fixed along the mast, rather than slidable along said mast. A fixed injector 48 results in a reduction in cost, simplicity of design and operation, reduction in weight, ease of collapsibility of the mast 34 into transportation position, and safety during transportation. It is to be understood however, that a sliding injector 48 may also be used in accordance with other embodiments of the present invention.

Figure 5:
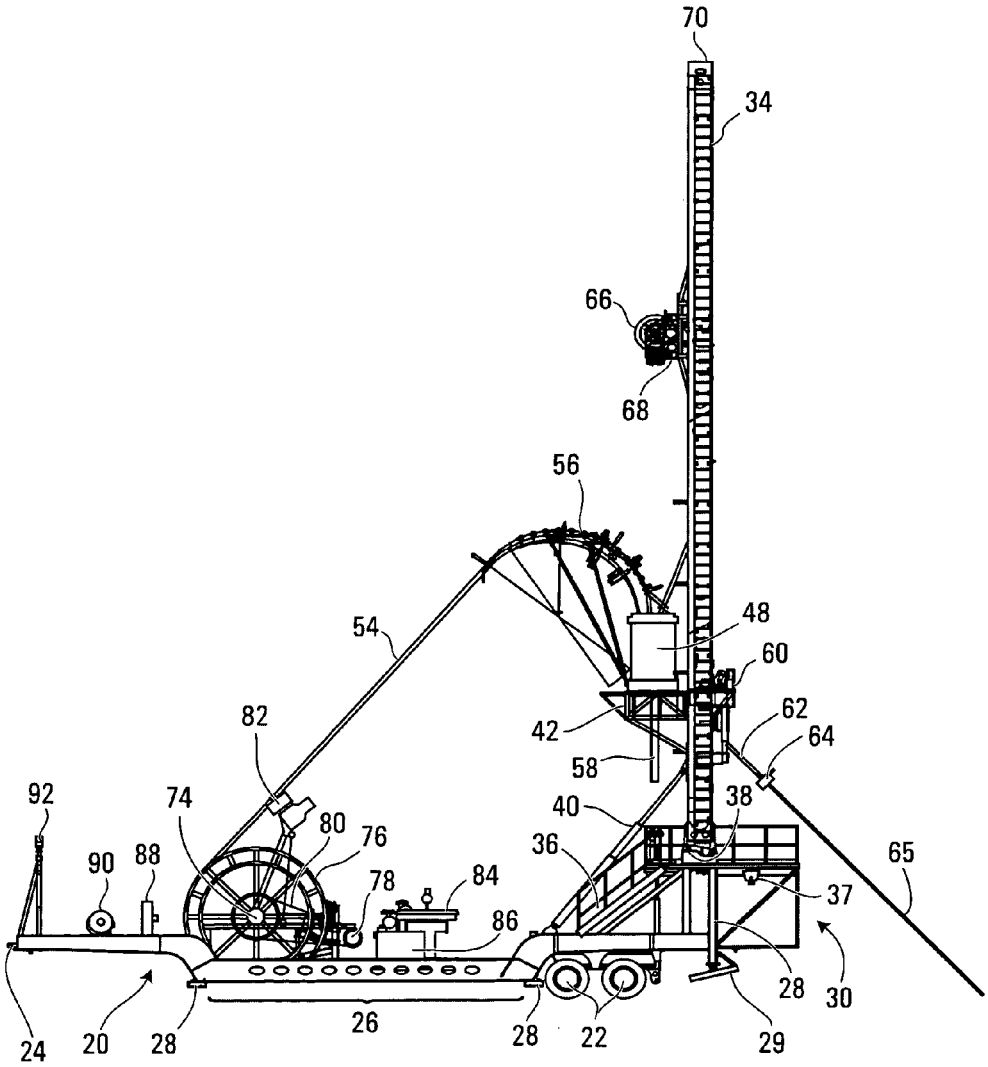
FIG. 5 is a side view of the rig of FIG. 1 shown in jointed-pipe pick-up mode.
Figure 6:
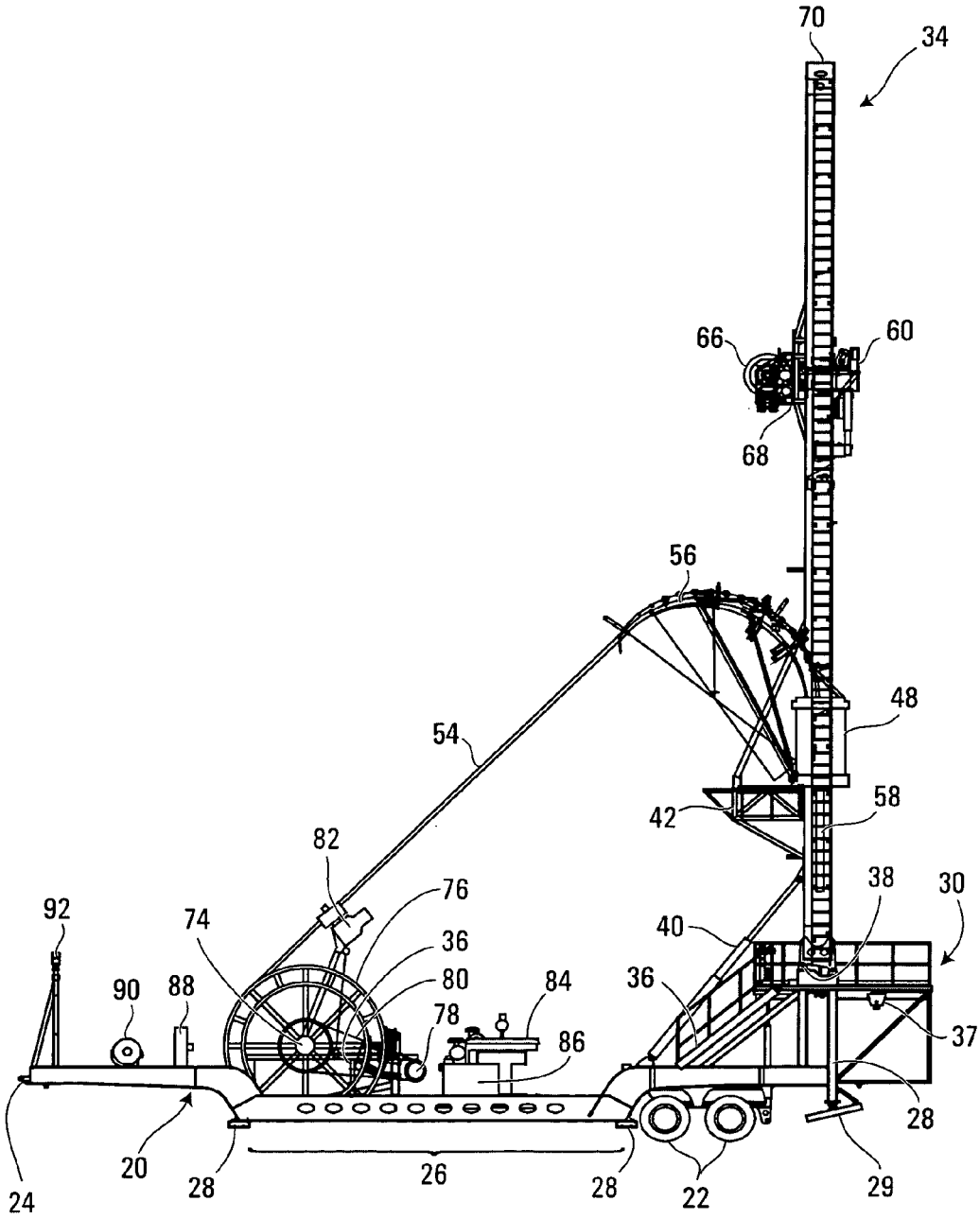
FIG. 6 is a side view of the rig of FIG. 1 shown in CT drilling mode.

The mast 34 of the preferred embodiment rig is composed in part of square tubing (not shown) running along a substantial portion of the length of the mast 34. Riding along, and slidable on this square tubing is a top drive 60 operable to engage and rotate downhole equipment (which equipment may or may not be in the well when engaged or rotated by the top drive 60) such as jointed-pipe, bottom hole assembly (BHA) elements, etc. As with the coiled tubing injector 48, the structure and functionality of top drives 60 are well known in the field and will not be discussed in detail herein. The top drive 60 of the preferred embodiment rig has on its underside, in line with the mast, a threaded engagement element 61 (FIGS. 13, 14) for threaded engagement with downhole equipment. As shown in FIG. 5, the top drive 60 also has pivotally connected to its underside, a pivotal engagement element consisting of links 62 extending downward, at the ends of which are mounted elevators 64. The links 62 are elongated arms which are pivotally connected to the underside of the top drive 60 by a pin-and-bolt connection. The angle at which the links 62 are situated at a given time is controlled by hydraulic cylinders (not shown) connected to the links 62 and to the body of the top drive 60.

Figure 13:
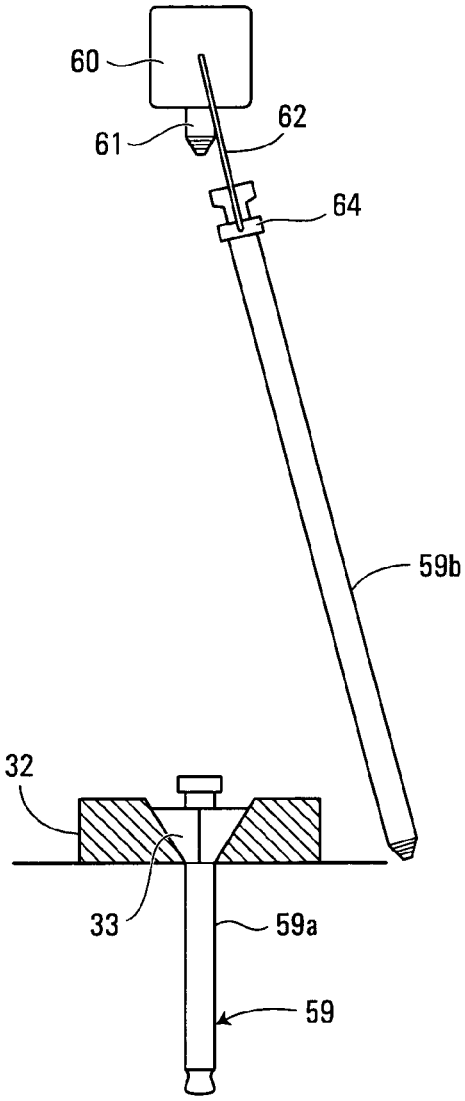
FIG. 13 is a schematic view of the top drive and elevators of the rig of FIG. 1, shown picking up an element of a bottom hole assembly.
Figure 14:
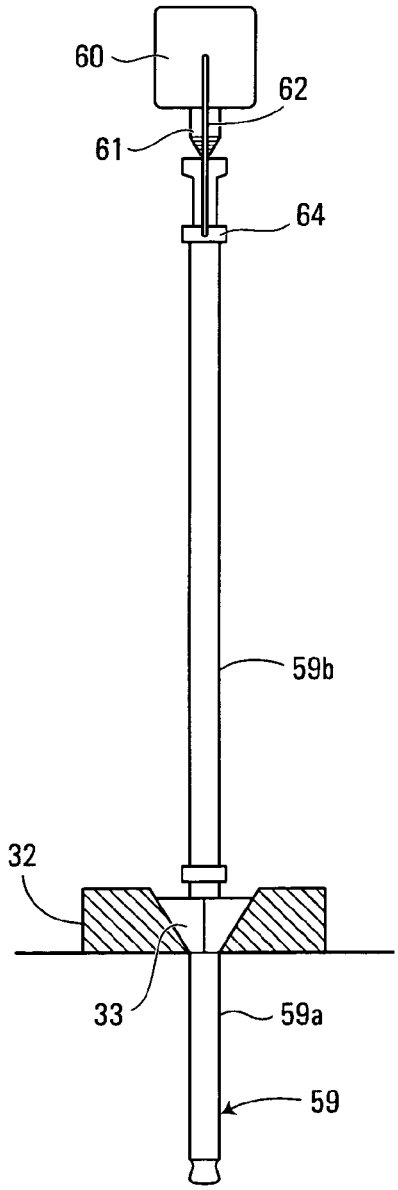
FIG. 14 is a schematic view of the top drive and elevators of the rig of FIG. 1, shown securing the element of FIG. 13 to a lower portion of the bottom hole assembly.

The elevators 64 are adapted to engage down-hole equipment such as jointed-pipe 65 (FIG. 5), casing, or BHA elements 59 (FIGS. 13, 14), but to also allow down-hole equipment to pass therethrough when upward force is exerted on the down-hole equipment, so as to engage the threaded engagement element. Typically, such down-hole equipment have a bulge or "tool joint" at their upper ends to accommodate engagement by tools such as elevators 64. FIG. 13 shows elevators 64 engaging the tool joint to pick up an element 59*b* of BHA 59. FIG. 14 shows elevators 64 moving downward relative to BHA element 59*b* as top drive 60 is lowered and BHA element 59*b* is supported on the lower portion 59*a* of BHA 59, which in turn is held by slips 33 in rotary table 32. The function of the links 62, the elevators 64 and the hydraulic cylinders controlling the angle of the links is to allow the top drive 60 to engage downhole equipment which are not necessarily in line with the mast. This feature allows the top drive 60 to pick up downhole equipment from a transport truck, for example, for placement into the well, as discussed further below.

The vertical movement of the top drive 60 along the mast 34 is controlled by a top drive winch 66 mounted on a winch platform 68 (shown in FIG. 10) which itself is mounted on the mast 34 above the injector platform 42. The winch 66 is motorized and winds or unwinds cabling in a controlled manner. This cabling extends from the top drive winch 66 up to the crown 70 of the mast 34, over pulleys 72, and down along the mast to the top drive 60. Thus, by operating the top drive winch 66, the movement of the top drive 60 along the mast 34 is controlled.

Figure 12:
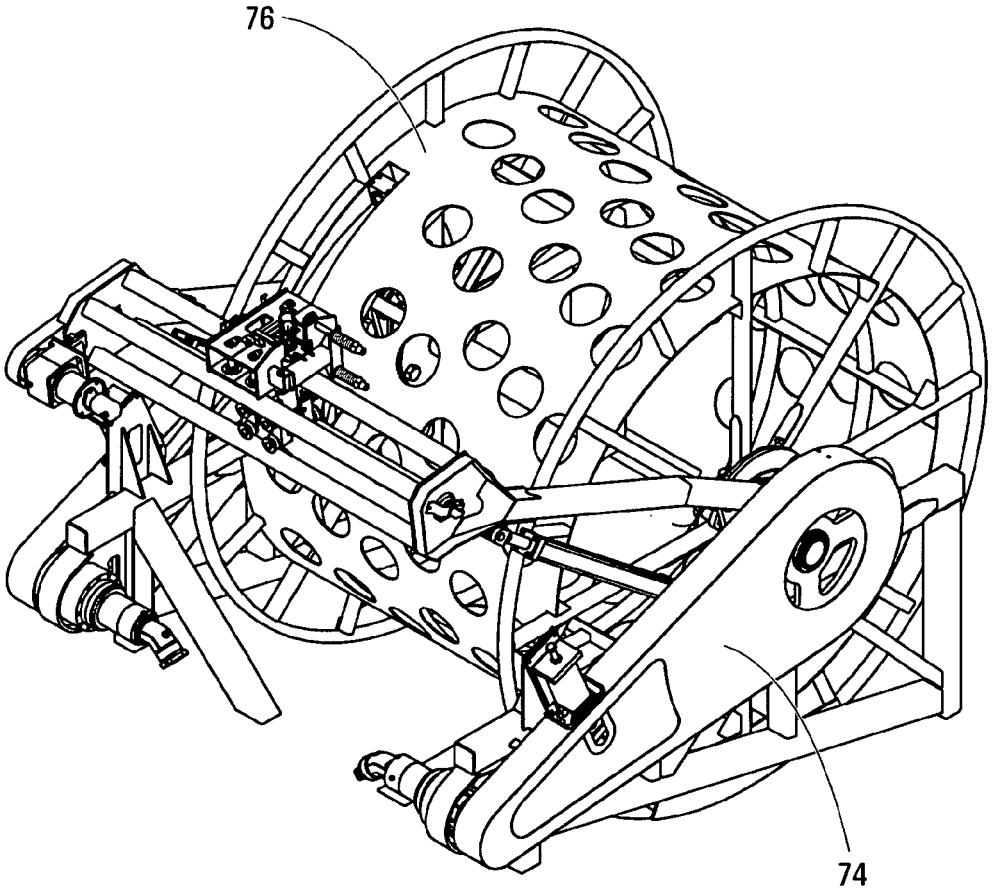
FIG. 12 is a perspective view of a spool of the rig of FIG. 1.

Near the forward end of the lowered middle portion 26 of the trailer 20 is a spindle 74 for mounting a coiled tubing spool 76. The spindle 74 (shown in detail in FIG. 12) consists of a pair of geared U-shaped brackets supported above the bed of the trailer 20. The spindle 74 also has a pair of closures (not shown) to fully engage the coiled tubing spool 76 once it is in place. The coiled tubing spool 76 is a spool having wound thereon coiled tubing 54. The coiled tubing spool 76 is rotated during drilling operations by a spool drive motor 78 connected to the spindle 74 by chains or belts 80. As coiled tubing 54 exits the coiled tubing spool 76 during drilling operations, it is guided and straightened by a coiled tubing guidance system, in this case a level wind 82 projected above the spindle 74. From the level wind 82, the coiled tubing 54 extends up to the injector arch 56. The coiled tubing guidance system also serves to wind the coiled tubing 54 evenly across the coiled tubing spool 76 when the coiled tubing 54 is being rewound back onto the spool 76. In the alternative to a level wind 82 which guides incoming coiled tubing 54 back and forth across the coiled tubing spool 76, the guidance system may also be for example a traversing system which moves the coiled tubing spool 76 itself back and forth.

Also located on the trailer 20 are an engine 84 for providing the power required to operate the various drilling components, a hydraulic tank 86 for storing hydraulic fluids for use in operating the various hydraulic cylinders located on the rig, a hydraulic cooler 88 for cooling the hydraulic fluid, a fuel tank 90 for storage of fuel for the engine 84, and a mast rest 92 located near the front of the trailer 20 extending above the trailer for supporting the mast 34 when the mast 34 is in transportation position.

In the preferred embodiment rig, each of the winch platform 68, the injector platform 42, the spindle 74, as well as the engine 84, hydraulic tank 86, hydraulic cooler 88, fuel tank 90 are located on the trailer 20 and on the mast 34 such that when the mast 34 is lowered into its transportation position such that the mast 34 is substantially horizontal, none of these elements impinges on the other elements.

In operation, the rig is stored and transported with the mast 34 in its transportation position, namely with the mast 34 in a substantially horizontal position. Once a site for a well has been identified, the trailer 20 of the preferred embodiment of the present invention is positioned such that the mast 34 when erected will be in line with the axis of the well to be drilled. When the trailer 20 is in position, the stabilizer legs 28 are extended such that their pontoons engage the ground. The stabilizer legs 28 are then adjusted so as to level the trailer 20. The mast 34 is then erected from its transportation position to its operating position wherein (in the case of the preferred embodiment rig of the present invention) the mast 34 is vertical. If a coiled tubing spool 76 is not already mounted on the spindle 74, one is put in place, and then the coiled tubing 54 is threaded through the level wind 82 up through the injector arch 56 and into the coiled tubing injector 48.

In a typical drilling application, the top drive 60 will then be used to drill a pilot hole using jointed-pipe 65 (FIG. 5). The process of jointed-pipe drilling is well known to those in the relevant field and is not discussed in detail here. The coiled tubing injector 48 is moved to its second position during this procedure, using the injector cylinders (not shown), such that the injector 48 is out of line with the mast 34 to allow the top drive 60 to drill using jointed-pipe 65.

Once a pilot hole has been drilled, casing (not shown) will typically be run into the pilot hole using the top drive 60 and cemented in place. Again, this process is well known to those in the field. The well is then ready for coiled tubing drilling.

The first step in the coiled tubing drilling stage using the preferred embodiment rig of the present invention is to assemble BHA assembly 59 (FIGS. 13, 14) and connect it to the end of the coiled tubing 54. As this preferred embodiment rig is uniquely suited to perform this task in an efficient manner, this procedure will be discussed in some detail.

The BHA 59 (FIGS. 13, 14) typically consists of the various elements to be located at the end of the coiled tubing 54 to allow coiled tubing 54 to be used for drilling. Of course BHA 59 may additionally, or alternatively consist of other down-hole equipment such as sensors or samplers used to determine properties of a particular down-hole formation. Typical drilling elements included in a drilling BHA 59 include a bit, a mud motor, drill collars, and survey tools. Each of the BHA elements 59 is typically threaded at its lower and upper ends so as to permit threaded engagement with each other, as well as with the threaded end of the coiled tubing 54.

During the first series of steps, it is necessary for the coiled tubing injector 48 to be placed in its second position in which the injector 48 is out of line with the mast. The top drive 60 is moved to a position near the bottom of the mast 34, but still some distance above the rotary table 32 so as to allow the insertion of BHA elements 59 therebetween.

A bottom element 59*a* of BHA 59 is then positioned such that it is in line with the mast 34 between the rotary table 32 and the top drive 60. Typically, BHA elements 59 are brought to the well site on a transport truck, and BHA elements 59 are placed into position using hydraulic lifting racks, a crane, an auxiliary winch located near the top of the mast 34, or by other suitable means. This bottom element 59*a* of BHA 59 is then moved downward so as to be inserted into the rotary table 32, as shown in FIGS. 13, 14. This first step may also be accomplished using the top drive 60 in a manner similar to that described below for the remaining elements of BHA 59. Slips 33 of rotary table 32 are then operated to engage the bottom element 59*a* of BHA 59.

Next, the hydraulic cylinders controlling the angle of the links 62 are operated to push the links out at a suitable angle as shown in FIG. 13, and a second element 59*b* of BHA 59 is positioned such that its upper end is adjacent to the elevators 64 of the top drive 60. Typically, the second element 59*b* of BHA 59 would be positioned at an angle to the mast 34 at this point, as shown in FIG. 13. The elevators 64 are then operated so as to engage this second element 59*b* of BHA 59. Because the links 62 to which the elevators 64 are mounted are connected to the remainder of the top drive 60 through a pivotal connection, this process of engaging the second element 59*b* of BHA 59 can take place even when the second element 59*b* of BHA 59 is not parallel to the mast 34. If necessary, the top drive 60 is then moved upward using the top drive winch 66 (FIG. 5) to position the second element 59*b* of BHA 59 such that it is in line with the mast 34. The top drive 60 is then lowered until the lower end of the second element 59*b* of BHA 59 is adjacent to the upper end of the bottom element 59*a,* as shown in FIG. 14. By further lowering the top drive 60, the second element 59*b* of BHA 59, is pushed up through the elevators 64, between the links 62, to lie adjacent to the threaded engagement element 61 of the top drive 60. The top drive 60 and/or the rotary table 32 are then operated to allow the top drive 60 to threadedly engage the second element 59*b* of BHA 59, and then to rotate the second element 59*b* of BHA 59 and the bottom element 59*a* of BHA 59 relative to each other so as to threadedly engage the second element 59*b* of BHA 59 with the bottom element 59*a* of BHA 59. Optionally, slips 33 of rotary table 32 may be operated at this point to release bottom element 59*a*, the top drive 60 may be moved down the mast 34 such that the second element 59*b* is inserted into the rotary table 32, and then slips 33 of rotary table 32 may be operated to engage the second element 59*b* of BHA 59. The top drive 60 is then operated to disengage from the second element 59*b* of BHA 59.

The steps in the above paragraph are then repeated for the remaining elements of BHA 59. When the final element of BHA 59 has been screwed into BHA, slips 33 of rotary table 32 typically release BHA 59, and the top drive 60 moves BHA 59 partly into the well. The slips 33 of rotary table 32 then engage BHA 59 again, and the top drive 60 disengages from BHA.

The top drive 60 is then moved to a location above the coiled tubing injector 48 so as to move it out of the way. The lubricator winch 52 is then operated to retract the lubricator 58, and the coiled tubing injector 48 is moved to its first position wherein the injector 48 is in line with the mast 34. Next, the coiled tubing injector 48 is operated to move coiled tubing 54 to a position such that its threaded end is adjacent to the upper end of BHA 59. The rotary table 32 is then operated to rotate BHA 59 relative to the coiled tubing so as to connect the two in threaded engagement, and the lubricator 58 is extended.

Finally, slips 33 of rotary table 32 release BHA 59 and the coiled tubing injector 48 is operated to drill the well.

When necessary to switch from coiled tubing operations to jointed-pipe operations, the coiled tubing 54 is extracted from the well such that BHA 59 is suspended below the coiled tubing injector 48. The coiled tubing injector 48 is then moved to its second position in which the injector 48 is out of line with the mast, so as to allow the top drive 60 to perform jointed-pipe operations.

When necessary to switch from jointed-pipe operations to coiled tubing operations, the jointed-pipe 65 (FIG. 5) is extracted from the well and moved out of the mast. The coiled tubing injector 48 is then moved to its first position in which the injector 48 is in line with the mast so as to be in a position to perform coiled tubing operations.

It is to be understood that the precise steps and the precise order of these steps do not need to be exactly as described above for the operation of the preferred embodiment rig of the present invention. Steps may be reordered, steps may be omitted, or other steps may be inserted without necessarily departing from the method of the present invention.

It is further to be understood that the particular configuration of the various components of the rig, and their relative location need not necessarily be exactly as described above.

It is also to be understood that the drilling rig of the present invention may also be used to set casing using the top drive once drilling has been completed. The rig can also be used for drill stem testing using the top drive and jointed-pipe.

Numerous modifications and variations of the present invention are possible in light of the above teachings. It is therefore to be understood that within the scope of the appended claims, the invention may be practised otherwise than as specifically described herein.

What is claimed is:

1. A rig for drilling a well comprising:

a base;

a mast mounted on said base;

a top drive operable to engage and rotate downhole equipment, slidably mounted on said mast for longitudinal sliding along said mast; and a coiled tubing injector operable to move coiled tubing in and out of said well, mounted on said mast such that the coiled tubing injector may be selectively transposed between a first position in which the injector is in line with the mast, to a second position in which the injector is out of line with the mast to accommodate manipulation of down-hole equipment by the top drive.

2. The rig of claim 1 wherein said rig further comprises:

a rotary table operable to engage and rotate downhole equipment, mounted on said base in line with said mast.

3. The rig of claim 2 wherein said coiled tubing injector is in a fixed position along the length of said mast.

4. The rig of claim 3 wherein said coiled tubing injector is mounted on said mast by means of:

rails mounted substantially perpendicular to the mast;

a dolly mounted on said rails for linear movement along said rails; and said coiled tubing injector mounted on said dolly.

5. The rig of claim 1 wherein said rig further comprises:

a winch mounted on said mast for controlling, in association with a cable wound on said winch and attached to said top drive, the longitudinal sliding movement of said top drive along said mast.

6. The rig of claim 1 wherein said top drive includes:

a threaded engagement element for threaded engagement with downhole equipment; and a pivotal engagement element pivotally mounted below said threaded engagement element to permit engagement of downhole equipment which is not in line with the mast, wherein said pivotal engagement element is adapted to allow downhole equipment to pass therethrough to engage the threaded engagement element when said downhole equipment is in line with said mast, and upward force is exerted on the downhole equipment.

7. The rig of claim 1 wherein said rig further comprises:

a storage reel spindle mounted on said base for accommodating rotational mounting of a coiled tubing storage reel;

a storage reel drive mounted on said base for rotating said coiled tubing storage reel; and a guidance system for guiding coiled tubing off of, and on to the coiled tubing storage reel.

8. The rig of claim 1 wherein said mast is pivotally mounted on said base, said rig further comprising:

tilt-control means for controlling the angle of the mast so as to accommodate off-vertical drilling.

9. The rig of claim 1 wherein said base is a wheeled carrier.

10. The rig of claim 9 wherein said mast is pivotally mounted on said base, said rig further comprising:

tilt-control means for controlling the angle of the mast so as to move the mast from a transportation position in which the mast is substantially parallel to the carrier, and an operating position in which the mast is substantially parallel to the well.

11. The rig of claim 9 wherein said rig further comprises:

retractable stabilizing legs mounted on said base for stabilizing said base relative to the ground, said stabilizing legs being retractable from an operating position in which the stabilizing legs are in contact with the ground, and a transportation position in which said stabilizing legs are lifted out of contact with the ground.

12. The rig of claim 11 wherein said stabilizing legs have mounted at their ends, pontoons.

13. The rig of claim 1 wherein said rig further comprises:

blow-out-preventer hangers mounted on said rig in line with said mast for lowering and lifting a blow-out-preventer on to and off of a wellhead.

14. The rig of claim 1 wherein said coiled tubing injector has mounted there-below a lubricator for guiding the coiled tubing, wherein said lubricator is telescoping to selectively allow access to said coiled tubing.

15. The rig of claim 2 wherein said top drive, coiled tubing injector and rotary table are adapted to assemble a bottom hole assembly.

16. The rig of claim 1 wherein said rig is adapted to selectively drill using coiled tubing and jointed-pipe.

17. A BHA (bottom hole assembly) assembling system for assembling a BHA for use in coiled tubing drilling, said BHA assembling system comprising:

a base;

a mast mounted on said base;

a top drive operable to engage and rotate BHA elements, slidably mounted on said mast for longitudinal sliding along said mast;

a coiled tubing injector operable to move coiled tubing on to and off of a BHA, mounted on said mast such that the coiled tubing injector may be selectively transposed between a first position in which the injector is in line with the mast, to a second position in which the injector is out of line with the mast to accommodate manipulation of BHA elements by the top drive; and a rotary table operable to engage and rotate BHA elements, mounted on said base in line with the mast.

18. The BHA assembling system of claim 17 wherein said coiled tubing injector is in a fixed position along said mast.

19. The BHA assembling system of claim 17 wherein said coiled tubing injector is mounted on said mast by means of:

rails mounted substantially perpendicular to the mast;

a dolly mounted on said rails for linear movement along said rails; and said coiled tubing injector mounted on said dolly.

20. The BHA assembling system of claim 17 wherein said BHA assembling system further comprises:

a winch mounted on said mast for controlling, in association with a cable wound on said winch and attached to said top drive, the longitudinal sliding movement of said top drive along said mast.

21. The BHA assembling system of claim 17 wherein said top drive includes:

a threaded engagement element for threaded engagement with downhole equipment; and a pivotal engagement element pivotally mounted below said threaded engagement element to permit engagement of downhole equipment which is not in line with the mast, wherein said pivotal engagement element is adapted to allow downhole equipment to pass therethrough to engage the threaded engagement element when said downhole equipment is in line with said mast, and upward force is exerted on the downhole equipment.

22. The BHA assembling system of claim 17 wherein said BHA assembling system further comprises:

a storage reel spindle mounted on said base for accommodating rotational mounting of a coiled tubing storage reel; and a storage reel drive mounted on said base for rotating said coiled tubing storage reel.

23. The BHA assembling system of claim 17 wherein said coiled tubing injector has mounted there-below a lubricator for guiding the coiled tubing, wherein said lubricator is telescoping to selectively allow access to said coiled tubing.

24. The BHA assembling system of claim 17 wherein said base is a wheeled carrier.

25. The BHA assembling system of claim 24 wherein said mast is pivotally mounted on said base, said BHA assembling system further comprising:

tilt-control means for controlling the angle of the mast so as to move the mast from a transportation position in which the mast is substantially parallel to the carrier, and an operating position in which the mast is substantially parallel to a well to be drilled.

26. The BHA assembling system of claim 24 wherein said BHA assembling system further comprises:

retractable stabilizing legs mounted on said base for stabilizing said base relative to the ground, said stabilizing legs being retractable from an operating position in which the stabilizing legs are in contact with the ground, and a transportation position in which said stabilizing legs are lifted out of contact with the ground.

27. The BHA assembling system of claim 26 wherein said stabilizing legs have mounted on their ends, pontoons.

28. The BHA assembling system of claim 17 wherein said BHA assembling system is also adapted to drill a well.

29. The BHA assembling system of claim 28 wherein said mast is pivotally mounted on said base, said BHA assembling system further comprising:

tilt-control means for controlling the angle of the mast so as to accommodate off-vertical drilling.

30. The BHA assembling system of claim 28 wherein said BHA assembling system is adapted to selectively drill using coiled tubing and jointed-pipe.

31. A method of assembling a plurality of threaded BHA (bottom hole assembly) elements into a BHA for use in coiled tubing drilling, each of said BHA elements having an upper end and a lower end, said method using a BHA assembling system having:

a base;

a mast mounted on said base;

a top drive operable to engage and rotate BHA elements, slidably mounted on said mast for longitudinal sliding along said mast;

a coiled tubing injector operable to move coiled tubing on to and off of a BHA, mounted on said mast such that the coiled tubing injector may be selectively transposed between a first position in which the injector is in line with the mast, to a second position in which the injector is out of line with the mast to accommodate manipulation of BHA elements by the top drive; and a rotary table mounted on said base in line with the mast, operable to engage and rotate BHA elements, said method comprising:

a) transposing the coiled tubing injector to its second position in which the injector is out of line with the mast;

b) sliding the top drive to a position along the mast in spaced relation to the rotary table;

c) placing a bottom element of BHA into the rotary table;

d) operating the rotary table to engage the bottom element of BHA;

e) placing a second element of BHA such that its upper end is adjacent to the top drive;

f) operating the top drive to engage the second element of BHA;

g) positioning the second element such that its lower end is adjacent to the upper end of the bottom element of BHA;

h) operating one of said top drive and said rotary table relative to the other to rotate one of the second element and the bottom element relative to each other so as to screw the two elements together;

i) operating the top drive to disengage the second element of BHA;

j) sliding the top drive along the mast to a position in spaced relation to the second element;

k) repeating steps e) through j) for the remaining elements of BHA;

l) sliding the top drive along the mast to a position above the coiled tubing injector;

m) transposing said coiled tubing injector to its first position in which the injector is in line with the mast;

n) operating said coiled tubing injector to move coiled tubing having a threaded end, to a position adjacent the assembled BHA;

o) operating said rotary table to rotate BHA so as to screw BHA onto said threaded end of the coiled tubing; and p) operating said rotary table to disengage BHA.

32. The method of claim 31 further comprising between steps h) and i):

h1) operating said rotary table to disengage the bottom element of BHA;

h2) sliding the top drive down so as to insert the second element of BHA into said rotary table; and h3) operating said rotary table to engage the second element of BHA.

33. The method of claim 31 wherein the top drive of the said BHA assembly system includes:

a threaded engagement element for threaded engagement with downhole equipment; and a pivotal engagement element pivotally mounted below said threaded engagement element to permit engagement of downhole equipment which is not in line with the mast, wherein said pivotal engagement element is adapted to allow downhole equipment to pass therethrough to engage the threaded engagement element when said downhole equipment is in line with said mast, and upward force is exerted on the downhole equipment, and wherein step f) is accomplished by:

operating the pivotal engagement element to engage the second element of the BHA.

34. The method of claim 33 wherein step g) is accomplished by:

once the upper end of the second element has been engaged by the pivotal engagement element of the top drive, moving the top drive along the mast away from the rotary table until the second element is in line with the mast, and then moving the top drive toward the rotary table until the lower end of the second element is adjacent the upper end of the bottom element.

35. The method of claim 34 wherein step h) includes:

first continuing to lower the top drive until the second element of BHA the passes through the pivotal engagement element and is adjacent to the threaded engagement element of the top drive, and said operation of one of said top drive and said rotary table threadedly engages the threaded engagement element of the top drive and the second element of BHA.

36. The method of claim 31 wherein once the final BHA element has been screwed onto the other elements of BHA using one of the top drive and the rotary table, operating the rotary table to disengage BHA, sliding the top drive along said mast toward the rotary table so as to move BHA partly into the well, operating the rotary table to re-engage BHA, and then operating the top drive to disengage the final BHA element.

37. A rig for drilling a well comprising:

a base;

a mast mounted on the base;

a coiled tubing platform mounted to the mast;

a coiled tubing injector operable to move coiled tubing in and out of the well, the coiled tubing injector being mounted on the coiled tubing platform for selective movement between a first position in which the injector is in line with the mast and a second position in which the injector is out of line with the mast;

a rotary table mounted on the base in line with the mast and below the coiled tubing injector platform, the rotary table having slips for supporting and rotating a bottom hole assembly for make-up with the coiled tubing of the coiled tubing injector;

a top drive having a threaded engagement member operable to engage and rotate a string of jointed pipe passing through the rotary table into the well when the tubing injector is in the second position, the top drive being slidably mounted on the mast for longitudinal sliding along the mast independent of the coiled tubing injector platform; and wherein the top drive remains in line with the mast above the coiled tubing injector while the coiled tubing injector is in the first position.

38. The rig according to claim 37, further comprising a set of elevators pivotally mounted to the top drive for slidably engaging separate elements of the bottom hole assembly and separate components of the string of jointed pipe, enabling the top drive to lift and position the separate elements and components in line with the mast.

39. A method for drilling a well with jointed drill pipe and performing operations in the well with coiled tubing, comprising:

(a) providing a rig with a mast, a coiled tubing platform having a coiled tubing injector mounted to the mast, a rotary table with slips below the coiled tubing injector platform, and a top drive mounted for longitudinal movement to the mast;

(b) for jointed pipe drilling, moving the coiled tubing injector to a position on the coiled tubing injector platform out of line of the mast, securing a threaded engagement member of the top drive to a string of jointed drill pipe, lowering the jointed drill pipe through the rotary table into the well, and rotating the string of jointed drill pipe with the top drive; and (c) for coiled tubing operations, supporting a bottom hole assembly in the well with slips of the rotary table, moving the coiled tubing injector to a position on the coiled tubing injector platform in line with the mast, moving a threaded end of the coiled tubing with the coiled tubing injector into engagement with a threaded upper end of the bottom hole assembly, and rotating the bottom hole assembly with the rotary table to make up the bottom hole assembly with the coiled tubing, then injecting the bottom hole assembly and the coiled tubing into the well and performing operations.

40. The method according to claim 39, wherein:

step (a) further comprises mounting a pivotal engagement member to the top drive; and step (c) further comprises making up separate elements of the bottom hole assembly by:

engaging a first element of the bottom hole assembly with the pivotal engagement member and with the top drive, placing the first element in the rotary table, then supporting the first element with the slips; then engaging a second element of the bottom hole assembly with the pivotal engagement member and with the top drive, placing a lower end of the second element on an upper end of the first element; then lowering the top drive and the pivotal engagement member relative to the second element until the threaded engagement member engages an upper end of the second element; then rotating a selected one of the threaded engagement member and the rotary table to secure the second element to the first element.

41. The method according to claim 39, further comprising: placing the top drive in line with the mast and above the coiled tubing injector platform while performing step (c).

* * * * *

UNITED STATES PATENT AND TRADEMARK OFFICE

CERTIFICATE OF CORRECTION

PATENT NO. : 6,973,979 B2
APPLICATION NO. : 10/690749
DATED : December 13, 2005
INVENTOR(S) : Carriere et al.

It is certified that error appears in the above-identified patent and that said Letters Patent is hereby corrected as shown below:

Column 7, line 23, delete "The" before "BHA"
Column 8, line 26, insert --the-- before "BHA"
Column 8, line 30, insert --the-- before "BHA"

Column 12, line 9, line 11, line 12, line 14, line 18, line 24, line 28, line 36, line 37, line 38, line 42, line 44, line 45, insert --the-- before "BHA"
Column 13, line 7, line 12, line 14, line 16, line 17, line 18, insert --the-- before "BHA"

Signed and Sealed this

Twenty-first Day of November, 2006

JON W. DUDAS
*Director of the United States Patent and Trademark Office*